US008911042B2

(12) United States Patent
Bassi et al.

(10) Patent No.: US 8,911,042 B2
(45) Date of Patent: Dec. 16, 2014

(54) REFRIGERATOR SHELF ADJUSTMENT SYSTEM WITH IN-SHELF LIGHTING

(75) Inventors: Alberto Bassi, Turin (IT); Marco Sclip, Sumirago (IT)

(73) Assignee: Illinois Tool Works Inc., Glenview, IL (US)

( * ) Notice: Subject to any disclaimer, the term of this patent is extended or adjusted under 35 U.S.C. 154(b) by 122 days.

(21) Appl. No.: 13/703,459

(22) PCT Filed: Aug. 12, 2011

(86) PCT No.: PCT/US2011/047592

§ 371 (c)(1), (2), (4) Date: Dec. 11, 2012

(87) PCT Pub. No.: WO2012/021807

PCT Pub. Date: Feb. 16, 2012

(65) Prior Publication Data

US 2013/0088136 A1 Apr. 11, 2013

Related U.S. Application Data

(60) Provisional application No. 61/373,410, filed on Aug. 13, 2010.

(51) Int. Cl.

| | |
|---|---|
| ***A47B 96/04*** | (2006.01) |
| ***A47B 97/00*** | (2006.01) |
| ***A47B 23/06*** | (2006.01) |
| ***F25D 27/00*** | (2006.01) |
| ***F25D 25/02*** | (2006.01) |
| ***A47B 57/48*** | (2006.01) |
| *F25D 23/06* | (2006.01) |
| *F25D 25/04* | (2006.01) |

(52) U.S. Cl.

CPC ..... *F25D 27/00* (2013.01); *F25D 25/02* (2013.01); *A47B 57/48* (2013.01); *F25D 25/024* (2013.01); *F25D 23/067* (2013.01); *F25D 25/04* (2013.01); *F25D 2400/40* (2013.01); *F25D 2500/02* (2013.01)

USPC ..... 312/408; 312/223.6; 362/92; 362/133

(58) Field of Classification Search

USPC ..... 312/408, 400, 306, 307, 304, 312, 351, 312/410, 223.6; 108/193, 147.16; 362/92, 362/133

See application file for complete search history.

(56) References Cited

U.S. PATENT DOCUMENTS 3,506,325 A * 4/1970 Horvay ..... 312/223.5
3,516,369 A * 6/1970 Bidak et al. ..... 108/138

(Continued)

FOREIGN PATENT DOCUMENTS

DE 3544446 C1 1/1987
DE 102007029182 A1 1/2009

(Continued)

OTHER PUBLICATIONS

An International Search Report, dated Jul. 3, 2012, issued in International Application No. PCT/US2011/047592.

*Primary Examiner* — Daniel Rohrhoff
*Assistant Examiner* — Kimberley S Wright

(57) ABSTRACT

An adjustable refrigerator shelf assembly receives electrical power through a loosely draped conductor held within a pocket on one side of the shelf assembly. The shelf assembly may include a detent mechanism allowing adjustment of the shelf assembly upward and downward by successive lifting and lowering of the shelf without direct manipulation of a detent or a lock allowing both the detent mechanism and conductor to be wholly covered at all times.

18 Claims, 4 Drawing Sheets

(56) References Cited

U.S. PATENT DOCUMENTS

| | | | | | |
|---|---|---|---|---|---|
| 3,551,612 | A * | 12/1970 | Guentner | 191/12 C |
| 4,489,995 | A | 12/1984 | Barr | |
| 4,689,726 | A * | 8/1987 | Kretzschmar | 362/127 |
| 5,034,861 | A * | 7/1991 | Sklenak et al. | 362/92 |
| 5,287,252 | A * | 2/1994 | Caruso | 362/92 |
| 5,357,874 | A * | 10/1994 | Palmer | 108/50.02 |
| 5,606,919 | A * | 3/1997 | Fox et al. | 108/50.02 |
| 6,042,244 | A * | 3/2000 | Witkoski | 362/133 |
| 6,113,198 | A * | 9/2000 | Hommes | 312/114 |
| 6,283,608 | B1 * | 9/2001 | Straat | 362/133 |
| 6,478,444 | B2 * | 11/2002 | Schaerer et al. | 362/133 |
| 6,527,406 | B1 * | 3/2003 | Slesinger et al. | 362/127 |
| 6,877,329 | B2 * | 4/2005 | Bassi | 62/229 |
| 6,904,764 | B2 * | 6/2005 | Bassi | 62/264 |
| 6,930,244 | B1 * | 8/2005 | Nebel | 174/486 |
| 7,338,180 | B2 * | 3/2008 | Wing | 362/92 |
| 7,434,951 | B2 * | 10/2008 | Bienick | 362/92 |
| 7,726,753 | B2 * | 6/2010 | Bassi | 312/272 |
| 7,740,332 | B2 * | 6/2010 | Bassi | 312/408 |
| 7,766,502 | B2 * | 8/2010 | Tress | 362/125 |
| 7,784,888 | B2 * | 8/2010 | Oh et al. | 312/223.6 |
| 8,033,622 | B2 * | 10/2011 | Oh et al. | 312/402 |
| 8,424,692 | B2 * | 4/2013 | Ala | 211/41.9 |
| 8,459,817 | B2 * | 6/2013 | Alberghetti et al. | 362/92 |
| 8,657,392 | B2 * | 2/2014 | Fabbro et al. | 312/408 |
| 2005/0179351 | A1 * | 8/2005 | Bassi | 312/408 |
| 2006/0087207 | A1 * | 4/2006 | Oh et al. | 312/402 |
| 2006/0186774 | A1 * | 8/2006 | Bassi | 312/404 |
| 2008/0121146 | A1 * | 5/2008 | Burns et al. | 108/23 |
| 2008/0278932 | A1 * | 11/2008 | Tress | 362/133 |
| 2008/0315735 | A1 * | 12/2008 | Fabbro et al. | 312/223.6 |
| 2009/0021927 | A1 * | 1/2009 | Hall et al. | 362/92 |
| 2011/0203302 | A1 * | 8/2011 | Alberghetti et al. | 62/264 |
| 2011/0273867 | A1 * | 11/2011 | Horst et al. | 362/133 |
| 2012/0106129 | A1 * | 5/2012 | Glovatsky et al. | 362/92 |
| 2012/0140440 | A1 * | 6/2012 | Dam et al. | 362/92 |
| 2012/0230015 | A1 * | 9/2012 | Zhu et al. | 362/94 |
| 2013/0193828 | A1 * | 8/2013 | Bassi | 312/408 |
| 2014/0139040 | A1 * | 5/2014 | Fabbro et al. | 307/104 |

FOREIGN PATENT DOCUMENTS

| | | | | |
|---|---|---|---|---|
| EP | 1605217 | A2 | 12/2005 | |
| EP | 1703238 | A1 | 9/2006 | |
| EP | 1950514 | A1 * | 7/2008 | F25D 27/00 |
| JP | 9-250870 | A | 9/1997 | |
| WO | 2009079209 | A1 | 6/2009 | |
| WO | WO 2009079209 | A1 * | 6/2009 | F21V 33/00 |
| WO | WO 2011019589 | A1 * | 2/2011 | |
| WO | WO 2011143059 | * | 11/2011 | F25D 25/02 |
| WO | WO 2011115957 | A3 * | 8/2012 | |

* cited by examiner

REFRIGERATOR SHELF ADJUSTMENT SYSTEM WITH IN-SHELF LIGHTING

CROSS REFERENCE TO RELATED CASE

This application is a National Stage of International Application No. PCT/US2011/047592 filed Aug. 12, 2011 and claims the benefit of U.S. Provisional Application No. 61/373,410 filed Aug. 13, 2010.

FIELD OF THE INVENTION

The present invention relates to refrigerator shelves and in particular to an adjustable refrigerator shelf providing in-shelf lighting.

BACKGROUND OF THE INVENTION

Lights in a refrigerator are typically mounted to the interior walls of the refrigerator compartment. While these lights provide sufficient illumination when the refrigerator is empty, when the shelves are filled with goods, light is blocked and portions of the shelves are cast in shadows.

One solution to this problem is placement of lighting systems on the shelves themselves, for example on the underside of the shelves to illuminate the contents of the shelf below or on the upper edges of the shelves to illuminate product on the shelf itself.

A problem with shelf-mounted lighting is getting electrical power to the lights. Refrigerator shelves are typically adjustable in position. While releasable electrical connectors could be provided for connecting electricity to the shelves, these connectors necessarily but undesirably break the continuous inner wall of the refrigerator and expose conductors making cleaning the inner surface of the refrigerator more difficult.

One solution to this problem is described in PCT patent application WO 2009/079209 having a filing date of Dec. 3, 2008 and entitled "Inductively Powered Light Assembly" assigned to the assignee of the present invention and hereby incorporated by reference. The invention described in this application uses inductively coupled power transfer between a primary coil positioned behind the walls of the refrigerator and corresponding coils on the shelves. An elongated primary coil spanning multiple shelf locations may be used to provide flexibility in the arrangement of the shelves.

An improvement in this design is described in pending U.S. application 61/314,833 filed Mar. 17, 2010 and entitled "High-Efficiency Wireless Lighting System" which provides a series of separate, smaller coils that provide more focused electrical coupling between power coils in the walls of the refrigerator and corresponding shelf coils on the shelves. Sensing of coil proximity may be used to efficiently disable coils not being used. This application is also assigned to the assignee of the present invention and hereby incorporated by reference.

It can be difficult to integrate the power coils required for a wireless lighting system into the refrigerator. Mounting the coils behind the refrigerator walls can present manufacturing challenges and the large size of the power transmission coils does not readily integrate into existing shelf brackets.

SUMMARY OF THE INVENTION

The present invention combines a shelf mechanism that allows for "blind" adjustment of the shelf between two positions with a flexible continuous conductor providing power to a shelf in either of the two positions. Because the shelf adjustment mechanism does not require access to the mechanism by the user, it may be wholly covered with a shroud that may also isolate and protect the flexible conductor. The present invention eliminates the need to break electrical conductors when the shelves are moved or for more sophisticated wireless energy transmission systems.

Specifically, the present invention provides an adjustable refrigerator shelf system having a shelf assembly providing a shelf and at least one lamp attached to the shelf assembly for illuminating a region of the shelf. A slide with a first and second slideably connected component has the first component attached to an inner wall of the refrigerator and the second component attached to the shelf assembly. A detent mechanism releasably holds the first and second components at a first and second relative position to locate the shelf assembly at a first and second height in the refrigerator. A shroud is attached to move with the shelf assembly adjacent to the inner wall, the shroud defining at least a portion of an enclosed volume proximate to the inner wall enclosing the detent mechanism. A flexible conductor is held within the enclosed volume providing a conductive path from a point on the inner wall to a point on the shelf assembly, the flexible conductor sized to coil and uncoil within the defined volume as the slide moves between the first and second relative locations.

It is a feature of at least one embodiment of the invention to provide a simple method of delivering electrical power to an illuminated shelf permitting simple adjustment of the shelf.

The adjustable refrigerator shelf system may further include a pocket having an opening and attachable to the inner wall with the opening facing inward into the refrigerator, the pocket cooperating with the shroud to define the enclosed volume.

It is a feature of at least one embodiment of the invention to provide a conductor system that may be wholly enclosed for protection of the conductor from damage or entanglement.

The shroud may have a vertical height less than a sum of a vertical height of the pocket and a vertical height difference between the first and second relative positions. In addition the shroud may be placed on the outside of the inner wall to communicate with an inside of the refrigerator through an opening in the inner wall having a vertical height less than the vertical height of the shroud to be covered by the shroud in both the first and second positions.

It is a feature of at least one embodiment of the invention to permit the shroud to cover the enclosed volume holding the conductor in all adjustment positions without unduly increasing the height of the shroud such as may necessitate a larger shelf separation. By partially covering the opening to the pocket, a large pocket size may be obtained with modest shroud sizes.

The detent mechanism may be an interengaging multi-step track and pin, one attached to the first component and one attached to the second component to permit the second component to stably rest at different heights on the first component in response to successive upward and downward motions of the second component.

It is a feature of at least one embodiment of the invention to provide an adjustment mechanism that may be wholly contained beneath the shroud to present a surface that is easy to clean.

The flexible conductor may have a length at least one and one half times a distance of vertical separation between the first and second positions.

It is a feature of at least one embodiment of the invention to eliminate the need for retractor mechanisms on the flexible conductor by allowing a natural coiling of the conductor facilitated by its excess length.

The point of attachment of the flexible conductor on the inner wall may be higher than the point of attachment on the shelf bracket at all positions between the first and second position.

It is a feature of at least one embodiment of the invention to provide a draping of the conductor providing a natural trap for moisture condensation.

The adjustable refrigerator shelf assembly may include an electrical connector providing a releasable junction in the flexible electrical connector between the first and second points.

It is a feature of at least one embodiment of the invention to permit simple installation or removal of the shelves for maintenance or assembly.

The electrical connector may be the first point of attachment of the flexible conductor.

It is a feature of at least one embodiment of the invention to conduct moisture away from the electrical connector.

Other features and advantages of the invention will become apparent to those skilled in the art upon review of the following detailed description, claims and drawings in which like numerals are used to designate like features.

Figure 1:
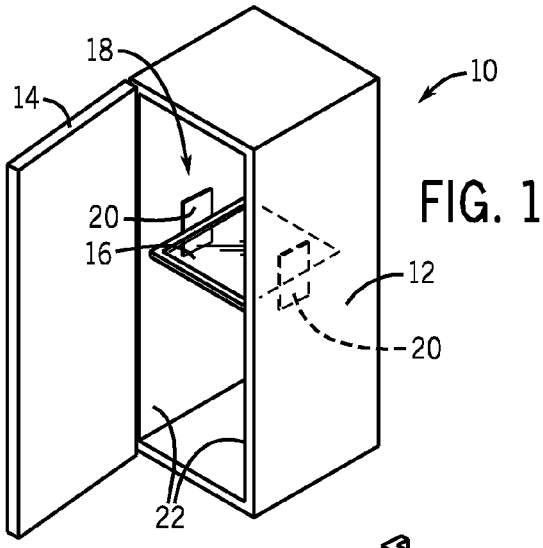
FIG. 1 is a front perspective view of a shelf assembly for use with the present invention showing a shelf supported against an inner wall of the refrigerator by a shelf bracket, having a shroud covering an adjustment mechanism that may be operated by movement of the shelf without access to the mechanism by the consumer.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a refrigerator 10 may provide for a housing 12 having left, right, top, bottom, and rear insulated walls together defining generally an enclosed rectangular volume open at the front. A door 14 may hinge at a front edge of one side wall to provide, when closed, a refrigerated volume maintained at a desired temperature by a compressor system or similar refrigeration system (not shown).

One or more horizontal, planar shelves 16 may be placed within the volume at various heights as supported by a mechanism 18 on the left and right sides covered by a shroud 20. The mechanism 18 provides a connection between the shelf 16 and opposed inner walls 22 of the refrigerator 10 allowing the shelf 16 to be raised and lowered between two different heights simply by pressure on the shelf without direct access to the mechanism 18.

Figure 2:
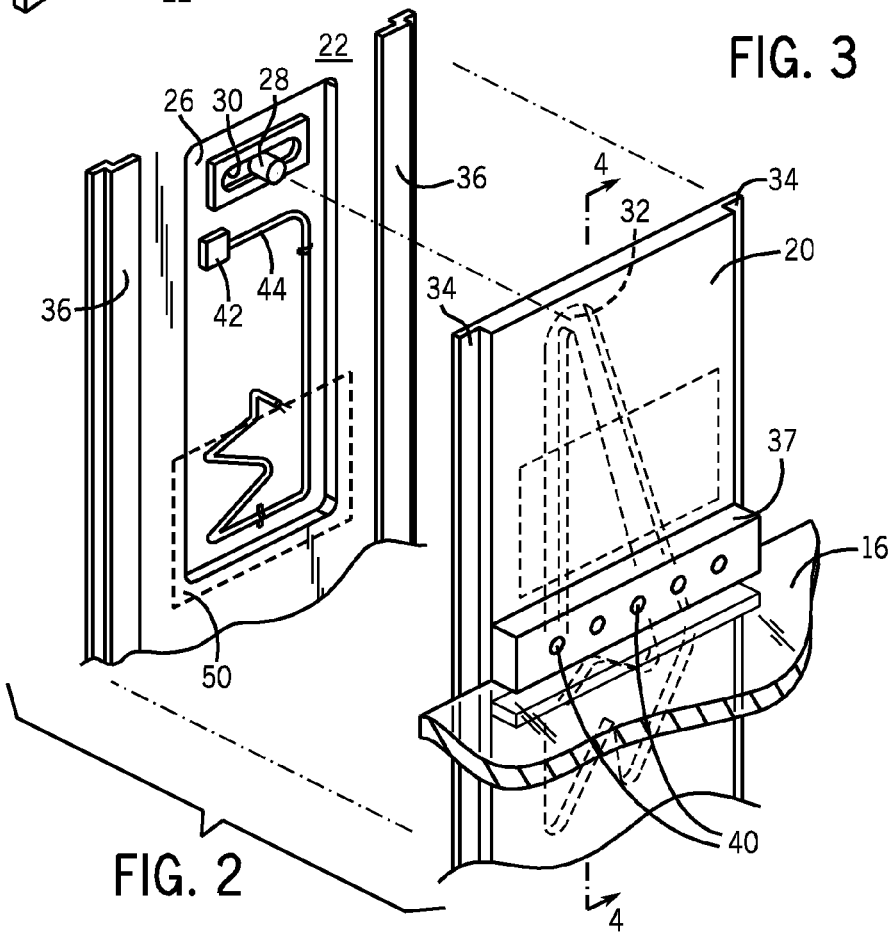
FIG. 2 is an exploded side elevational view of the adjustment mechanism and shroud showing the positioning of a flexible conductor within a cavity in the refrigerator wall.

Referring now to FIG. 2, the walls 22 of the refrigerator 10 may include a generally rectangular recessed pocket 26 having at its upper end a pin 28 extending outward therefrom and retained in a horizontal slide track 30 to move horizontally left and right. The pin 28 may engage a cardioid multi-step track 32 facing the pin 28 from a rear surface of the shroud 20 which, as will be described below, cooperates to stably hold the shroud 20 in an upper or lower position. The shroud 20 may be retained slideably against the pocket 26 by a vertical guide mechanism, for example, outwardly extending left and right vertical tracks 34 on the shroud 20 engaging corresponding channels 36 positioned to the left and right of the pocket 26. This or a variety of other mechanisms may be used to constrain the shroud 20 for vertical travel with respect to the pocket 26.

Figure 4:
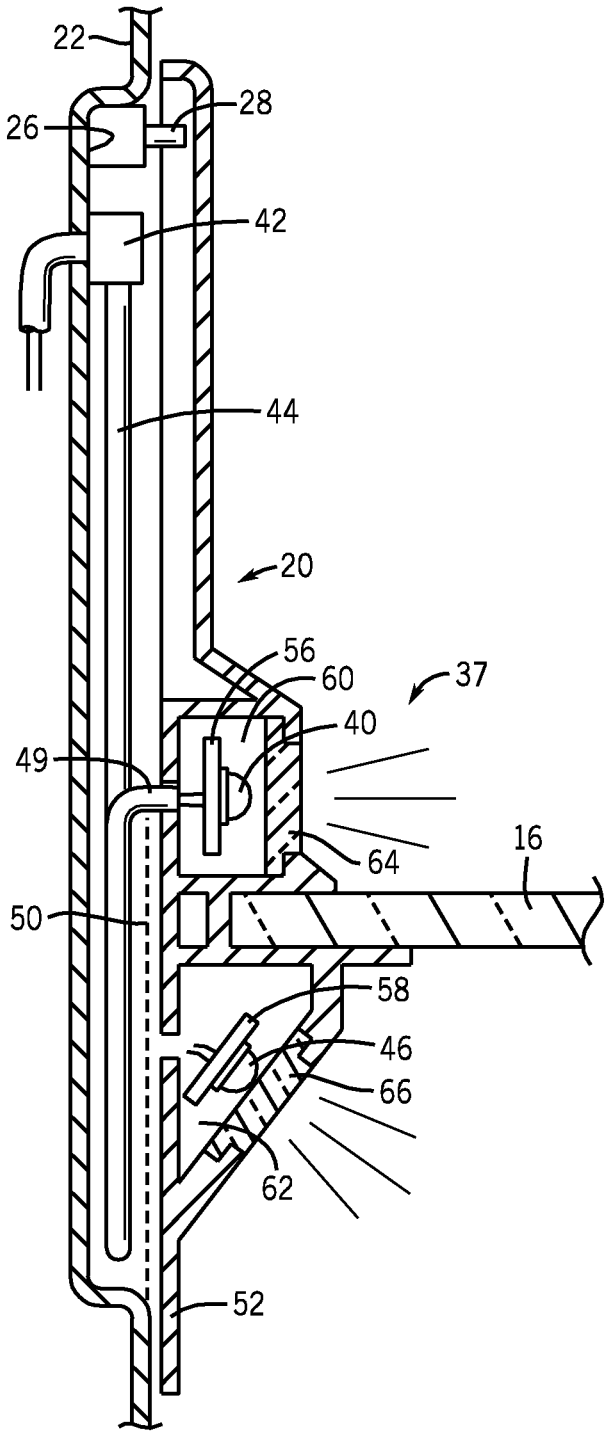
FIG. 4 is cross-sectional elevational view of the assembled shroud and mechanism of FIG. 2 showing alternative locations for LED illumination of a shelf.

A surface of the shroud exposed to the refrigerator volume may support a shelf bracket 37 holding the shelf 16 and providing illuminators 40, for example, using light emitting diodes (LEDs) that may illuminate the top of the shelf 16 or, in a different embodiment shown in FIG. 4, a bottom of the next lower shelf. Motion of the shroud 20 moves the shelf 16 correspondingly.

Referring still to FIG. 2, a connector 42 within the pocket 26 may attach to a source of power behind the wall 22 to join to a flexible electrical cable 44 that may pass in the pocket 26 to the bottom of the pocket 26 to be loosely coiled (in a zigzag planar form) within the pocket 26 behind the shroud 20. The lower portion of the pocket 26 may be covered by a portion 50 of the inner wall 22 of the refrigerator as will be described in more detail below. Generally, the term "coil" as used herein contemplates any bundling or folding of the flexible electrical cable 44 into the pocket 26.

Figure 3:
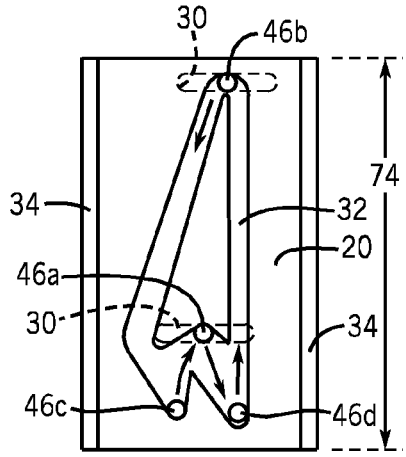
FIG. 3 is a front elevational phantom view of a cardioid track formed in the rear surface of the shroud of FIG. 2 engaging a movable pin to allow blind adjustment of the shelf between the first and second elevation.

Referring now to FIGS. 2 and 3, the cardioid multi-step track 32 may be a groove extending into the shroud 20 from its rear face and is generally an inverted heart-shape (cardioid) having two lower lobes joining to an upper vertex. The cardioid multi-step track 32 guides the pin 28 as it moves between two stable positions: a lower position (with respect to the shroud 20) with the pin 28 at position 46*a* being in a notch between the lobes of the cardioid, and an upper position with the pin at position 46*b* at the uppermost vertex of the cardioid multi-step track 32. The upper position of the pin 28 represents the lowest position of the shelf 16 and vice versa. Starting with the shroud 20 at its lower position where the pin 28 is at upper position 46*b* on the shroud 20, the cardioid multi-step track 32 is generally asymmetric so that the pin 28, starting at position 46*b* and moving downward with respect to the shroud 20 with a lifting of the shelf 16 and shroud 20, will follow a leftmost groove of the cardioid multi-step track 32 to a position 46*c* in the leftmost lobe of the cardioid multi-step track 32 where the pin 28 is trapped against further relative downward motion.

Downward motion of the shelf 16 and shroud 20 from position 46*c* requires the pin 28 to rise to position 46*a* where it supports the cardioid multi-step track 32 to hold the shelf 16 in a second position elevated with respect to the shelf position when the pin 28 was at position 46*b* where it started.

New, upward motion on the shelf 16 and shroud 20 causes the pin 28 to move downward relative to the shroud 20 to position 46*d* in the rightmost lobe of the cardioid multi-step track 32 where subsequent upward motion of the pin 28 from this position (by downward motion of the shroud 20) causes it to return to position 46*b*.

Thus, successive upward and downward motion on the shelf 16 (and hence shroud 20) by the consumer moves the shelf 16 bi-stably between upper and lower positions. As the pin 28 moves through the cardioid track, it may slide within slide track 30 slightly to accommodate left and right movement of the pin 28 necessary to follow the cardioid multi-step track 32. A cardioid track of similar design is described generally in European patent EP 1563762 filed Feb. 16, 2005 and entitled: "Easy Height Adjustment Device for Refrigerator Shelves" assigned to the assignee of the present invention and hereby incorporated by reference.

It will be understood that the relative positions of the cardioid multi-step track 32 and the pin 28 may be reversed to provide for a similar mechanism with the cardioid track inverted.

Referring now to FIG. 4, the cable 44 may connect to a printed circuit board 56 and/or printed circuit board 58 held in the shelf bracket 37 after passing through an entry point 49 in the shelf bracket 37, the cable 44 providing power to one or more LEDs 40 contained in a compartment 60 or 62 of the shelf bracket 37 behind a transparent or translucent window 64 or 66.

The shelf 16 may be a plate of tempered glass so that light from the LEDs 40 on top of the shelf 16 may illuminate the shelf 16 and some light may pass through the shelf 16 to illuminate a lower shelf. Conversely, light from LED 40 below the shelf 16 may illuminate the next shelf below and by reflection through the shelf above.

Figure 5:
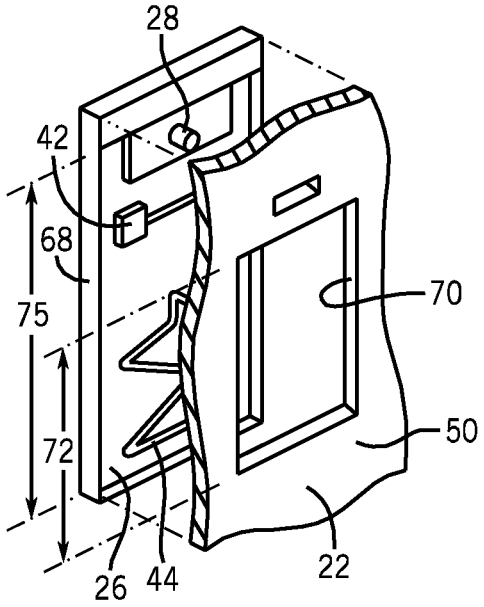
FIG. 5 is an exploded fragmentary view of an inner wall of the refrigerator showing mounting of a pocket assembly outside of the inner wall for holding the flexible conductor.

Referring now to FIG. 5, the pocket 26 may be a separate assembly 68 providing a shallow tray opening on one face. The assembly 68 may be attached to the inner wall 22 from outside the inner wall 22 so that an open face of the pocket 26 is exposed through an opening 70 cut in the inner wall 22. The opening 70 in the inner wall 22 may be smaller in vertical height than a vertical height of the pocket 26, thus minimizing the breach through the refrigerator wall 22. The assembly 68 may support the pin 28 and hold the connector 42 and cable 44.

Figure 6A:
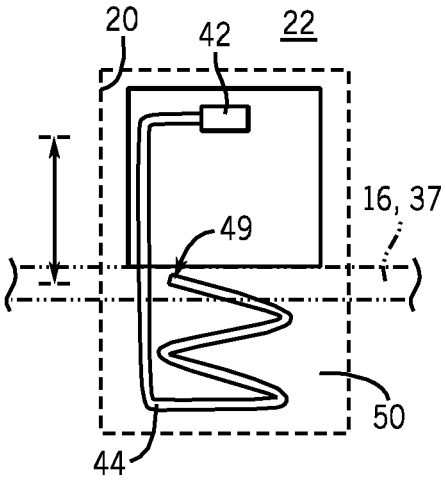
FIGS. 6*a* and 6*b* are elevational views of the opening of FIG. 5 from just outside of the inner wall looking into the refrigerator showing coiling of the flexible conductor with the shelf in a first and second position.
Figure 6B:
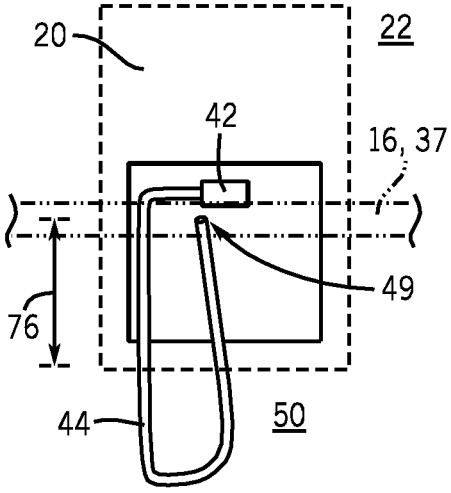

Referring also to FIGS. 6*a* and 6*b*, a vertical height 72 of the opening 70 in one embodiment will be no greater than the vertical height 74 of the shroud 20 (shown in FIG. 3) minus the vertical separation 76 between the two positions of the shelf 16 in its stable resting states as defined by the cardioid multi-step track 32 (shown in FIG. 3). In this way, the vertical height 74 of the shroud 20 may be minimized while still covering the opening 70 when the shelf 16 is both in its lowermost position (shown in FIG. 6*a*) and in its uppermost position (shown in FIG. 6*b*). This smaller opening 70 permits a smaller shroud 20 in turn permitting closer spacing of the shelves 16 in the refrigerator 10. More generally, the shroud 20 can be constrained to have a vertical height 74 that is less than the sum of the vertical height 75 of the opening of the pocket 26 and the vertical separation 76 of the shelf positions. A shroud 20 having a height equal to this sum would be required if the opening 70 had the same height as the pocket 26. This ability to thus increase size the pocket 26 while keeping it covered by the shroud 20 permits a reduced bending of the cable 44 and allows the weight of the cable 44 to provide a natural retraction of the cable 44 into the pocket 26 without retraction mechanisms or the like.

When the shelf 16 is in its lowermost position, the cable 44 may coil behind a portion 50 of inner wall 22 whereas when the shelf 16 is in its uppermost position the cable 44 may yet drape in a single loop downward from the connector 42. In all cases, the connector 42 will be higher than the shelf and an entry point 49 in the shelf bracket 37.

Figure 7B:
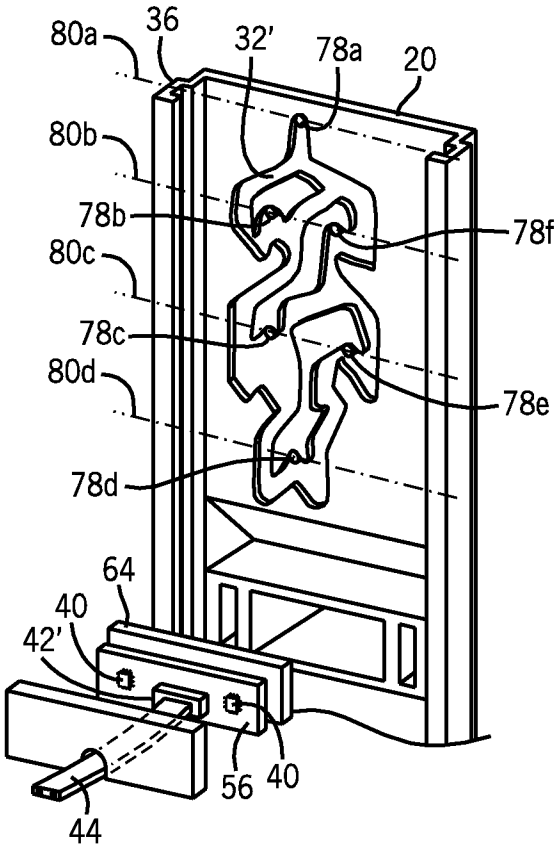
FIGS. 7*a* and 7*b* are front and rear perspective views of an alternative shroud design providing for multiple levels of track adjustment.
Figure 7A:
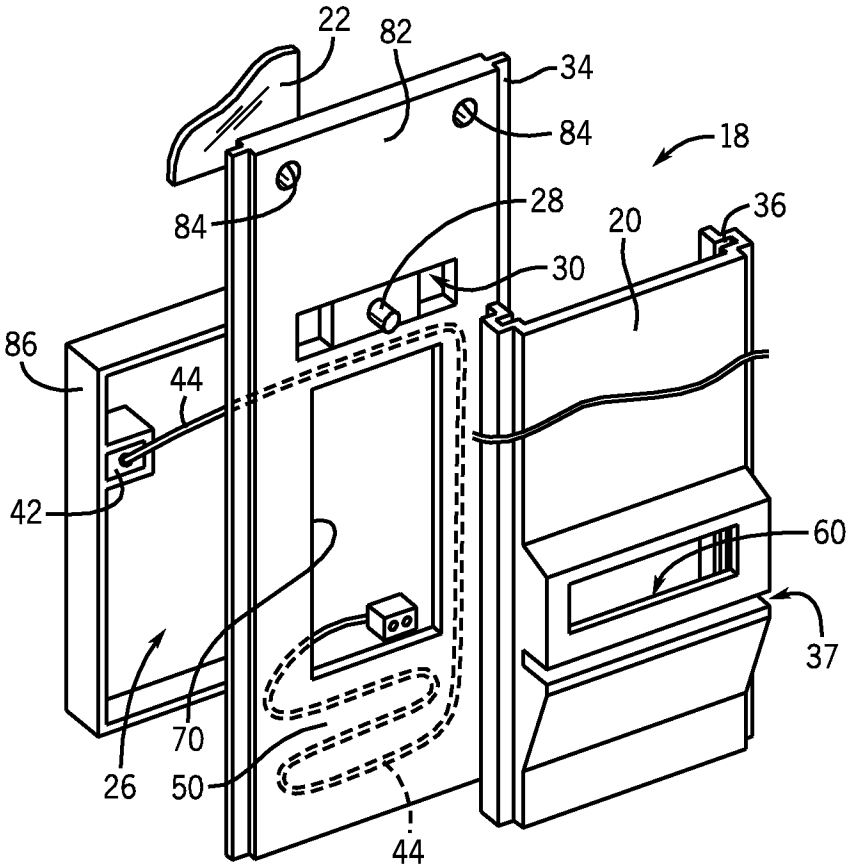

Referring now to FIGS. 7*a* and 7*b*, in an alternative design, more than two different heights of shelf adjustment may be obtained by a brachiated multi-step track 32' operating according to a similar principle as the cardioid multi-step track 32 described above, but having more than two stable resting positions. Specifically the brachiated multi-step track 32' provides six stable resting positions 78*a*-78*e* at which the pin 28 may support the shroud 20. In particular, this design provides four different levels 80*a*-80*d* (from highest to lowest on the shroud 20) at which the shroud 20 and hence the shelf (not shown in FIG. 7) may be positioned stably by sequential upward and downward movement of the shroud 20 with respect to the refrigerator wall 22.

During the adjustment process, the pin 28 may move from the highest resting position 78*a* at level 80*a* (lowest shelf position), then with upward then downward motion to resting position 78*b* at level 80*b*, and similarly and subsequently to resting position 78*c* at level 80*c* and then to resting position 78*d* at level 80*d*. Continued upward then downward motion may then cycle the pin 28 upward, first to resting position 78*e* at level 80*c*, and then to resting position 70*f* at level 80*b*, and finally again to resting position 78*a*. It will be appreciated, from these two examples of the cardioid multi-step track 32 and the brachiated multi-step track 32', which arbitrary numbers of levels 80 may be provided including different numbers of levels when moving the shelf up as opposed to when moving the shelf down, with the same shroud 20.

The embodiments of FIGS. 7*a* and 7*b* also depict an alternative method of attaching the shroud 20 to the wall 22 of the refrigerator 10 by using a wall-mounted panel 82 that may be attached to the inner surface of the wall 22, for example, by self tapping screws (not shown) and mounting holes 84 in the panel 82. The wall-mounted panel 82 may support on its rear surface (with respect to the interior of the refrigerator 10) a separate component 86 providing for the pocket 26, such component 86 as may fit through a hole in the wall 22 or be contained entirely in the thickness of the wall mounted panel 82. In this embodiment, the vertical tracks 34 may most readily be placed on the wall-mounted panel 82 and the corresponding channels 36 placed on the shroud 20. A separate connector 42' may attach the cable 44 (which may be a flat cable) to the printed circuit card 56.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An adjustable refrigerator shelf system comprising:

a shelf assembly providing a shelf and at least one lamp attached to the shelf assembly for illuminating a region of the shelf;

a slide having a first and second slideably connected component, the first component attachable to an inner wall of the refrigerator and the second component attachable to the shelf assembly;

a detent mechanism releasably holding the first and second components at a first and second relative position to locate the shelf assembly at a first and second height in the refrigerator;

a shroud attached to move with the shelf assembly adjacent to the inner wall, the shroud defining at least a portion of an enclosed volume proximate to the inner wall enclosing the detent mechanism;

a flexible conductor held within the enclosed volume providing a conductive path from a point on the inner wall to a point on the shelf assembly, the flexible conductor sized to coil and uncoil within the enclosed volume as the slide moves between the first and second relative locations.

2. The adjustable refrigerator shelf system of claim 1 further including a pocket having an opening and attachable to the inner wall with the opening facing inward into the refrigerator, the pocket cooperating with the shroud to define the enclosed volume.

3. The adjustable refrigerator shelf system of claim 2, wherein the shroud has a vertical height less than a sum of a vertical height of the pocket and a vertical height difference between the first and second relative positions, wherein the shroud may be placed on an outside of the inner wall to communicate with an inside of the refrigerator through an opening in the inner wall having a vertical height less than the vertical height of the shroud to be covered by the shroud in both the first and second positions.

4. The adjustable refrigerator shelf system of claim 1, wherein the detent mechanism is an interengaging multi-step track and pin, one attached to the first component and the other attached to the second component to permit the second component to stably rest at two different heights on the first component in response to successive upward and downward motions of the second slide component.

5. The adjustable refrigerator shelf assembly of claim 4, wherein the multi-step track is attached to move with the shelf surface and the pin is affixed to the inner wall of the refrigerator.

6. The adjustable refrigerator shelf assembly of claim 5, wherein the shroud is attached to and covers the multi-step track.

7. The adjustable refrigerator shelf assembly of claim 1, wherein the flexible conductor has a length of at least a distance of vertical separation between the first and second positions.

8. The adjustable refrigerator shelf assembly of claim 1, wherein the point on the inner wall is higher than the point on the shelf assembly at all positions between the first and second position.

9. The adjustable refrigerator shelf assembly of claim 1, further comprising an electrical connector for providing a releasable junction in the flexible electrical connector between the first and second points.

10. The adjustable refrigerator shelf assembly of claim 9, wherein the electrical connector is the first point.

11. A refrigerator having an adjustable refrigerator shelf system, the refrigerator comprising:

a refrigerator housing for providing an opening flanked by inner sidewalls;

at least one shelf assembly for providing a shelf and at least one lamp attached to the shelf assembly for illuminating a region of the shelf;

first and second slides each having first and second slideably connected components, the first component attached to different ones of the inner walls of the refrigerator and the second component attached to opposite sides of the shelf assembly;

detent mechanisms for releasably holding the first and second components at first and second relative positions to locate the shelf assembly at first and second heights in the refrigerator, respectively;

shrouds attached to move with the shelf assembly adjacent to the inner walls, the shrouds defining at least a portion of enclosed volumes proximate to the inner walls enclosing the detent mechanisms; and a flexible conductor held within one of the enclosed volumes providing a conductive path from a point on one inner wall to a point on the shelf assembly, the flexible conductor sized to coil and uncoil within the enclosed volume as the first and second slide move between the first and second relative locations.

12. The refrigerator of claim 11, wherein the at least one inner wall of the refrigerator includes an opening therethrough and further including a pocket attachable outside of the opening through the inner wall with the pocket accessible through the opening, the pocket cooperating with the shroud to define the enclosed volume.

13. The refrigerator of claim 12, wherein the shroud has a vertical height less than a sum of a vertical height of the pocket and a vertical height difference between the first and second relative positions and wherein the opening in the inner wall has a vertical height less than the vertical height of the shroud to be covered by the shroud in both the first and second positions.

14. A method of adjusting a shelf in a refrigerator, the shelf having:

a shelf assembly for providing a shelf and at least one lamp attached to the shelf assembly for illuminating a region of the shelf;

a slide having first and second slideably connected components, the first component attachable to an inner wall of a refrigerator and the second component attached to the shelf assembly;

a detent mechanism for releasably holding the first and second components at first and second relative positions to locate the shelf assembly at first and second heights in the refrigerator, the detent mechanism having an interengaging multi-step track and pin, one attached to the first component and the other attached to the second component to permit the second component to stably rest at two different heights on the first component in response to successive upward and downward motions of the second slide component;

a shroud attached to move with the shelf assembly adjacent to the inner wall, the shroud defining at least a portion of an enclosed volume proximate to the inner wall enclosing the detent mechanism; and a flexible conductor held within the enclosed volume providing a conductive path from a point on the inner wall to a point on the shelf assembly, the flexible conductor sized to coil and uncoil within the enclosed volume as the slide moves between the first and second relative locations, the method comprising:

lifting the shelf assembly from a first position to guide the pin through the multi-step track to a first position blocking further lifting of the shelf assembly;

releasing the shelf assembly to be supported by the pin in at a second position different from the first positions and blocking further descent of the shelf assembly;

lifting the shelf assembly to guide the pin through the multi-step a track to a third position different from the first positions blocking further lifting of the shelf assembly;

releasing the shelf assembly to be supported by the pin at a fourth position different from the second position and blocking further descent of the shelf assembly, wherein movement of an illuminated shelf is obtained without direct manipulation of the detent mechanism or disconnection of electrical power.

15. The adjustable refrigerator shelf system of claim 1, wherein a portion of the detent mechanism is directly supported by a refrigerator wall.

16. A refrigerator comprising:

the adjustable refrigerator shelf system of claim 1, wherein the refrigerator includes a refrigerator wall, and wherein the detent mechanism is directly supported by the refrigerator wall.

17. The method of claim 14, wherein, a portion of the detent mechanism is directly supported by a refrigerator wall.

18. The refrigerator of claim 11, wherein the refrigerator includes a refrigerator wall, and wherein a portion of the detent mechanism is directly supported by the refrigerator wall.

* * * * *